United States Patent [19]

Droll

[11] Patent Number: 4,499,688

[45] Date of Patent: Feb. 19, 1985

[54] WALL HANGING

[76] Inventor: Frances Droll, 7930 E. Camelback Rd., Apt. #108, Scottsdale, Ariz. 85251

[21] Appl. No.: 336,517

[22] Filed: Jan. 4, 1982

[51] Int. Cl.[3] ..... A01G 9/02

[52] U.S. Cl. ..... 47/83; 47/67

[58] Field of Search ..... 47/83, 67; D11/143; 52/660, 663; 220/83; 248/311.2, 216.1, 301, 220.1; 211/104

[56] References Cited

U.S. PATENT DOCUMENTS

| | | | |
|---|---|---|---|
| D. 262,274 | 12/1981 | Lahr | D11/143 |
| 505,230 | 9/1893 | Robinson | 248/220.1 |
| 2,683,022 | 7/1954 | Molow | 248/216.1 |
| 2,815,910 | 12/1957 | Baker | 248/220.1 |
| 2,916,235 | 12/1959 | Nogel | 248/216.1 |
| 3,159,369 | 12/1964 | Wiczer | 248/301 |
| 3,511,106 | 5/1970 | Deeby | 248/220.1 |
| 4,049,126 | 9/1977 | Halverson | 211/104 |
| 4,333,287 | 6/1982 | Lewis | 52/663 |

FOREIGN PATENT DOCUMENTS

| | | | |
|---|---|---|---|
| 598789 | 12/1978 | Switzerland | 47/83 |

*Primary Examiner*—Robert A. Hafer
*Assistant Examiner*—Bradley M. Lewis
*Attorney, Agent, or Firm*—Barnes, Kisselle, Raisch, Choate, Whittemore & Hulbert

[57] ABSTRACT

A wall hanging including a rectangular lattice and a planter having hooks thereon cooperative with the lattice for securing the planter to the lattice with the lattice in relative positions with respect to the planter angularly related by 90°.

3 Claims, 9 Drawing Figures

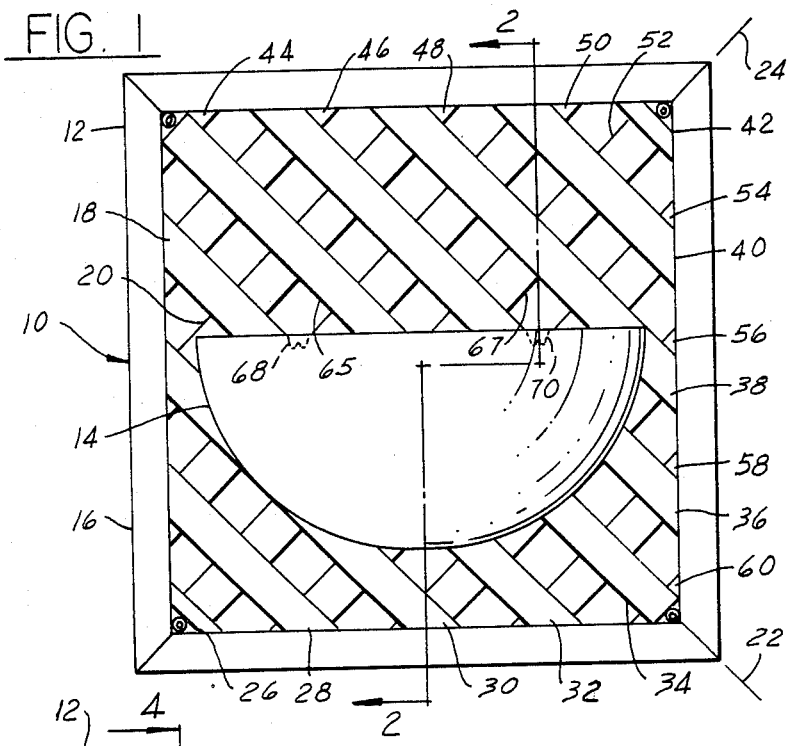
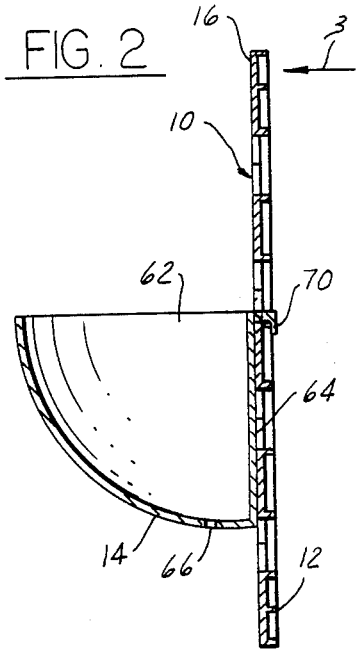
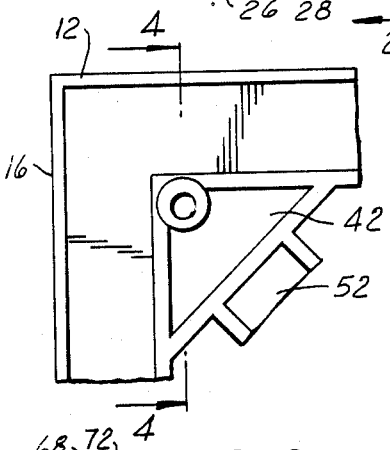
FIG. 3
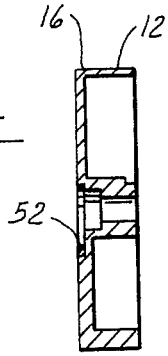
FIG. 4
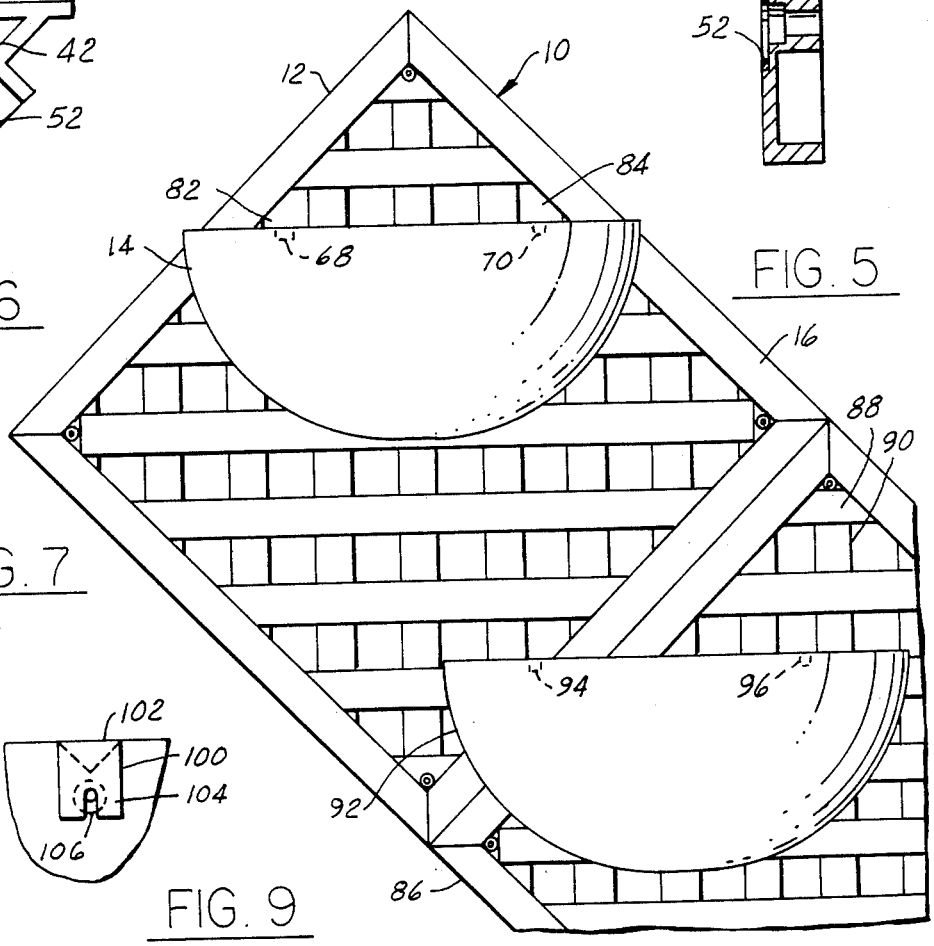
FIG. 5
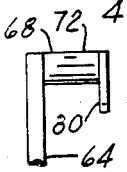
FIG. 6
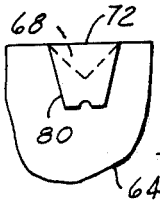
FIG. 7
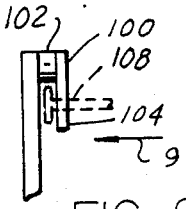
FIG. 8
FIG. 9

WALL HANGING

BACKGROUND OF THE INVENTION

1. Field of the Invention

The invention relates to planters and refers more specifically to a wall hanging including a lattice adapted to be hung on a wall and a planter having means for securing the planter to the lattice with the planter and lattice in different 90° positions relative to each other.

2. DESCRIPTION OF THE PRIOR ART

In the past, wall hangings have been known wherein planters have been secured to a member hung on a wall. With such past wall hangings, the planter has been rigidly secured to the member or at best has been capable of being associated therewith in one specific relation and with the member in one specific angular orientation on the wall. Such structure does not provide the versatility desired and required in decorating.

SUMMARY OF THE INVENTION

In accordance with the present invention there is provided a wall hanging wherein a member for supporting a planter may be oriented in a plurality of different angular positions on a wall separated 90° with respect to each other and a planter may be secured to the member for supporting a planter in various angular positions of the wall hanger.

In addition, the member for supporting the planter of the wall hanging of the invention is so constructed and arranged that a plurality of such member may be positioned thereon to span adjacent members.

Specifically, the member for supporting the planter is a lattice having two individual groups of lattice members positioned in parallel spaced apart relation extending at 90° to each other and at 45° to the sides of the lattice. The planter is a quarter sphere having hooks thereon cooperative with the lattice to extend through openings through the lattice and downwardly behind the lattice to secure the planter to the lattice.

BRIEF DESCRIPTION OF THE DRAWINGS

FIG. 1 is a plan view of the wall hanging of the invention.

FIG. 2 is a section view of the wall hanging of the invention taken substantially on the line 2—2, in FIG. 1.

FIG. 3 is an enlarged plan view of the back of one corner of the lattice illustrated in FIG. 1, taken substantially in the direction of arrow 3, in FIG. 2.

FIG. 4 is a partial section view of the lattice of the invention taken substantially on the line 4—4, in FIG. 3.

FIG. 5 is a front view of the wall hanging of the invention illustrating a lattice in a position 45° with respect to the position of the lattice shown in FIG. 1, and showing a second lattice adjacent thereto with a planter extending between the lattices and rotated 45° with respect thereto in comparison with their relative positions as shown in FIG. 1.

FIG. 6 is an enlarged elevation view of the hook structure of the planter of the wall hanging illustrated in FIG. 1.

FIG. 7 is a rear view of the hook structure illustrated in FIG. 6 taken substantially in the direction of arrow 7 in FIG. 6.

FIG. 8 is an elevation view of modified hook structure similar to FIG. 6 constructed to allow direct hanging of the planter on nails protruding from a wall as well as hanging on a lattice.

FIG. 9 is a rear view of the hook structure illustrated in FIG. 8 showing a nail slot therein.

DESCRIPTION OF THE PREFERRED EMBODIMENT

As shown best in FIGS. 1 and 2, the wall hanging 10 of the invention includes a lattice 12 and a planter 14.

The lattice 12 and planter 14 are so contructed and arranged that they cooperate to permit securing of the planter 14 to the lattice in various locations thereon with the lattice 12 and planter 14 in different relative angular positions separated by 45° from each other.

In addition, the lattice is constructed and arranged so that a plurality of lattices may be positioned adjacent each other to cover or form a complete wall with planters being secured to individual lattices or spanning between adjacent lattices.

More specifically, the lattice 12 as shown best in FIG. 1, is rectangular and includes an outer peripheral frame portion 16. Within the frame portion 16, the lattice includes groups 18 and 20 of parallel spaced apart individual lattice members extending parallel to the diagonals 22 and 24 of the square lattice 12. The individual lattice members of the group 18 includes the members 26,28,30,32,34,36,38,40, and 42. The lattice group 20 includes members 44,46,48,50,52,54,56,58, and 60. The groups 18 and 20 of lattice members extend at 90° to each other in spaced apart relation a distance not greater than half the dimension of the planter in the same direction and substantially equal to the width of the lattice members in the same direction and parallel to the diagonals of the lattice. As shown, the individual members of the groups 18 and 20 form squares therebetween which are positioned at 45° with respect to the outer frame 16.

The planter 14 is essentially a quarter sphere having an open top 62 and a closed back 64. The planter 14 has a dimension in the plane of the lattice approximately three quarters of the dimension of the edge of the lattice in the plane of the lattice. The planter 14 further is provided with a weep hole 66 through which excess water placed in the planter may drip.

In addition, hook members 68 and 70 are provided on the planter 14 and are cooperable with the lattice 12 to secure the planter 14 to the lattice 12 by extending through the front of the lattice mounted on a wall and down behind the lattice through separate openings in the lattice in various positions on the lattice 12 and with the lattice 12 oriented in different positions with respect to the planter 14 angularly separated by 45°.

More specifically, the hooks 68 and 70 are identical and are shown best in FIGS. 6 and 7. The hook 68 shown in FIG. 7, includes the portion 72 secured to the back 64 of the planter 14, which has a triangular cross sectional configuration. Hook 68 further includes the downwardly extending portion 80 shaped as shown in FIG. 6 and 7. The portion 72 of the hook 68 is adapted to extend through an opening in the lattice 12, while the portion 80 extends downwardly behind the lattice 12 to prevent the planter 14 from falling down or pulling away from the lattice 12.

As will be seen, the triangular configuration of the hook 68 exactly compliments the triangular configuration of the corner of the square defined by the individual lattice members 32 and 50. Thus, with the planter and lattice 12 in position shown in FIG. 1, the planter is rigidly secured to the lattice 12.

With the lattice 12 positioned at 45° with respect to the position shown in FIG. 1, as shown in FIG. 5, the planter 14 again may be secured to the lattice 12 by the hooks 68 and 70 passing through openings such as openings 82 and 84 in the lattice 12.

Further, as shown in FIG. 5, a second lattice 86 may be positioned adjacent lattice 12 at either of the four sides of the lattice 12. With such positioning of adjacent lattices, the lattice structures 12 and 86 are so constructed and arranged that the individual groups of lattice members 88 and 90 of lattice 86 appear to be continuations of the individual group of lattice members 18 and 20. Thus, as shown in FIG. 5, the planter 92 is secured with one hook 94 in the lattice 12 and one hook 96 in the lattice 86.

Further, it will be understood that the individual lattices, such as lattice 12 and 86 may be secured together to form a separate wall or divider with planters 14, and 92 positioned thereon as desired. With such structure the individual lattices may not only be placed side by side, but also back to back.

In another modification of the invention as shown best in FIGS. 8 and 9, the hooks 100 are constructed so that portions 102 are shorter and portions 109 are larger and have nail receiving slots 106 therein. With such structure, the modified planters may be secured directly to a wall or the like from which nail heads 108 protrude.

While one embodiment of the present invention and modification thereof has been considered in detail, it will be understood that other embodiments and modifications of the invention are contemplated.

Thus, for example, the lattice 12 need not be square and need not be limited to members crossing each other at 90°. In the broadest sense, any member capable of supporting the planter 14 with different angular orientations between the member and planter is intended to be included in the scope of the invention. Also, the planter need not be a quarter sphere, but may take any desired shape. Further, the relative angular orientation between the member and planter may be any relative angular orientation.

It is the intention to include all such modifications and embodiments of the invention as are defined by the appended claims within the scope of the invention.

I claim:

1. A wall hanging comprising a square lattice specifically adapted to be secured to a wall and to support a planter secured thereto including a plurality of separate groups of linear lattice members extending at 90° to each other in spaced apart relation a distance not greater than half the dimension of the planter in the same directions and substantially equal to the width of the linear lattice members in the same direction and parallel to the diagonals of the square lattice, said planter including separate spaced apart means cooperative with the square lattice member for securing the planter to the square lattice member with the planter in different relative angular positions with respect to the square lattice member oriented at 45° with respect to each other which spaced apart means for securing the planter to the square lattice includes at least two spaced apart separate right angle hooks on the planter which hooks are separated by a dimension in the plane of the lattice approximately three quarters of the dimension of the edge of the square lattice in the plane of the lattice and include portions extending through the front of the lattice mounted on a wall and down behind the lattice through separate openings in the lattice with the lattice and planter in either of two angularly related positions with the hook portions extending over the individual members of the lattice and which hooks have a triangular cross section complimentary to the angle formed by the intersection of adjacent linear lattice members with the sides of the square lattice parallel and perpendicular to a horizontal plane and which hooks are spaced apart horizontally with the planter positioned on a wall with the sides of the lattice parallel and perpendicular to the horizontal a dimension exactly equal to the distance between next adjacent openings in the lattice.

2. Structure as set forth in claim 1, wherein the hook portions have a free end and include slots extending thereinto from the free end thereof for hanging the planter on nails.

3. Structure as set forth in claim 1, and further including a plurality of further square lattices positioned adjacent the first square lattice with the peripheral frame of the lattices being such that the individual square lattice members form continuations of the individual linear lattice members of the individual square lattices whereby planters may be secured between adjacent square lattices with hooks secured in openings in adjacent lattices.

* * * * *